United States Patent [19]

Beaulieu

[11] 3,932,128

[45] Jan. 13, 1976

[54] DYE CARRIERS FOR POLYAMIDE FIBERS

[75] Inventor: Robert J. Beaulieu, Bronx, N.Y.

[73] Assignee: Millmaster Onyx Corporation, New York, N.Y.

[22] Filed: Jan. 29, 1975

[21] Appl. No.: 544,891

[52] U.S. Cl. ..... 8/173; 8/41 B; 8/42 B; 8/74; 8/165; 8/169; 8/178 R; 8/175

[51] Int. Cl.[2] ..... D06P 5/04

[58] Field of Search ..... 8/173, 169

[56] References Cited

UNITED STATES PATENTS

| | | | |
|---|---|---|---|
| 3,184,436 | 5/1965 | Magat | 260/78 |
| 3,282,886 | 11/1966 | Gadecki | 260/45.7 |
| 3,393,210 | 7/1968 | Speck | 260/371 |
| 3,510,891 | 5/1970 | Luongo | 8/173 |
| 3,702,229 | 11/1972 | Campana | 8/62 |
| 3,756,773 | 9/1973 | Isharani | 8/173 |
| 3,836,327 | 9/1974 | Bartsch | 8/173 |

*Primary Examiner*—Donald Levy
*Assistant Examiner*—A. L. Clingman
*Attorney, Agent, or Firm*—Arthur A. Jacobs, Esq.

[57] ABSTRACT

Carriers for dyes for polyamide fibers of DuPont's Type 472 nylon Qiana wherein the carriers contain a mixture of (a) either para-tertiary butyl phenol or para-tertiary amyl phenol and (b) normal butyl benzoate, such mixture comprising a swelling agent.

16 Claims, No Drawings

DYE CARRIERS FOR POLYAMIDE FIBERS

It is well known in the art of dyeing fibers that special auxiliary chemicals are often necessary to achieve the even and rapid exhaustion of dyes from an aqueous dye bath onto hydrophobic fibers. Such auxiliary chemicals are usually required when the dyestuff has very little affinity for, or solubility in, the fiber. When the dyestuff and the fiber have great affinity for each other, the fiber usually absorbs the dye directly, without the aid of auxiliary chemicals; and when the dyestuff is "soluble" in the fiber, the fiber that is immersed in an aqueous dispersion of the dyestuff acts, in principle, like an immiscible organic solvent would behave if the dye were being partitioned between the water and the solvent.

On the other hand, when the chemical and physical properties of the fiber and dyestuff are such as to preclude the possibility of an adequate rate of either "absorption" or "solution" then it is generally necessary to utilize certain physical or chemical techniques. Among the physical techniques is the use of higher temperatures at higher pressures, while one of the chemical techniques involves the use of carriers.

The term "carrier", as used herein, means a chemical compound, or a formulation of chemical components, which acts towards fibers much as a plasticizer acts towards a solid polymer. It swells, and softens the fibers and facilitaties the even diffusion of dyestuff molecules into the filaments.

Although some polyamide fibers may be readily dyed without the aid of carriers, a number of such fibers require such carriers. Furthermore, even with the use of the ordinary carriers, it has been found that certain polyamide fibers cannot be satisfactorily dyed. More specifically, such difficulty has been found in the dyeing of polyamide fibers that are made by the condensation of the monomers 4,4′-diaminodicyclohexyl methane, or alkylated derivatives thereof, and dodecanedioic acid. The structure and properties of these fibers, which are often referred to by the "Du Pont" trade names "Nylon type 472" or "Qiana", are disclosed in U.S. Pat. No. 3,393,210. This same patent also discloses that these fibers may be dyed under high pressure and temperature with the aid of some of the carriers customarily used for dyeing polyester fibers. But actual practice has shown that the conventional carriers used for polyester dyeing were not entirely satisfactory for these materials. In this respect, although it was, at first, believed that butyl benzoate, by itself, was satisfactory, subsequent experience has proved otherwise.

Although disperse dyes are somewhat more readily applied than acid or pre-metalized dyestuffs, many of the disperse dyes have lower light and wash resistance than acid dyes or pre-metalized dyes. In addition, they generally lack the brightness of shade of acid dyes. It is, therefore, important that the carrier be capable of utilization with all three types of dyes.

It is also well known in the art that carriers which contain water-insoluble components must be formulated with certain additives which cause these water-insoluble components to be evenly emulsified or dispersed in the aqueous dye bath without separation into aqueous and non-aqueous phases during the dyeing procedure. Such separation of phases during dyeing, often referred to as "oiling out", leads to "spotted" or "speckled" fabrics.

It is, therefore, one object of the present invention to provide a carrier for dyestuffs which is highly satisfactory for the dyeing of polyamide fibers that are made by the condensation of 4,4′-diamino-dicyclohexyl methane or its alkylated derivatives and dodecandioic acid.

Another object of the present invention is to provide a carrier of the aforesaid type that is effective for the application to such polyamide fibers not only of disperse dyes but also of acid dyes and pre-metalized dyes, thereby avoiding the necessity of storing different carriers for different types of dyes.

Another object of the present invention is to provide a carrier of the aforesaid type which can be dispersed evenly and completely throughout the aqueous phase in the dye without "oiling out" during the dyeing process.

A further object of the present invention is to indicate the best mode of using the carrier of the present invention with either disperse dyes, acid dyes or pre-metalized dyes in such manner that an even and rapid build-up of the dyestuff is attained on the fibers.

Other objects of the present invention will be evident from the following description and claims:

In accordance with the present invention, a carrier is used which contains a swelling agent consisting of a mixture of (a) either para-tertiary butyl phenol or para-tertiary amyl phenol and (b) normal-butyl benzoate. A carrier containing this synergistic mixture is much more effective in accelerating dye exhaustion, and produces a much higher quality of dyeing on the polyamide fibers here concerned than can be achieved by a carrier containing either of these compounds alone, or with any of the carriers described in the prior art. In addition, the carrier of the present invention can be used with a wider range of dyes, including disperse dyes, acid dyes and pre-metalized dyes, than any of the carriers of the prior art.

Preferably, the normal-butyl benzoate and alkyl phenol are present in the swelling agent in a ratio of about 1 to 1 by weight, although acceptable results are also obtained when these components are present in the range of between about 1 to 2 to about 2 to 1 by weight.

The complete carrier should, preferably, contain no more than about 80% of the swelling agent, the remainder of the carrier comprising any compatible material which will permit the swelling agent to be dispersed evenly in the aqueous dye composition. Preferably, it should permit the swelling agent to be evenly dispersed in about 10 to 50 times its weight of water.

As indicated above, the essence of the present invention is the use of the particular swelling agent. Any dispersing agent that will permit the swelling agent to be properly dispersed in the water is within the scope of the invention. However, it has been found that a particularly satisfactory dispersing agent is one which includes anionic surfactants, non-ionic surfactants, and coupling solvents (sometimes called compatiblizers, misciblizers or solubilizers), and most preferably where these components are present in the proportions of about 10% by weight anionic surfactants, about 5% by weight non-ionic surfactants, and about 5% by weight coupling solvent, based on the total weight of the carrier.

The above may be expressed by the following general formula:

| Components | Parts by Weight |
|---|---|
| Para-tertiary butyl phenol or para-tertiary amyl phenol | 30–50 |
| Normal-butyl benzoate | 50–30 |
| Anionic surfactant | 10 |
| Non-ionic surfactant | 5.0 |
| Coupling solvent | 5.0 |

The following Table 1 lists six different formulations made with specific components of the above type. In these formulations, a specific, readily available anionic surfactant, a specific, readily available non-ionic surfactant, and a specific, readily available coupling solvent is used. However, although these are preferable compounds, they are merely illustrative of the variety of such compounds that may be used to perform the same purposes. In this respect "ICONOL-PNP-4", a product of the Whitestone Chemical Co., Spartanburg, S.C., is a phosphorylated and ethoxylated nonyl phenol and "CONCO Sulfate 912" is the sodium salt of a sulfated ethoxylated alcohol, both being anionic surfactants, while "CONCO NI-40" is a non-ionic ethoxylated nonyl phenol. The latter two substances are commercially available from the Continental Chemical Company, Clifton, N.J.

Table 1

| Formula number<br>Components | I | II | III | IV | V | VI |
|---|---|---|---|---|---|---|
| para-tertiary butyl phenol | 40.0 | 30.0 | 50.0 | | | |
| para-tertiary amyl phenol | | | | 40.0 | 30.0 | 50.0 |
| butyl benzoate | 40.0 | 50.0 | 30.0 | 40.0 | 50.0 | 30.0 |
| "ICONOL-PNP-4" | 7.5 | 7.5 | 7.5 | 7.5 | 7.5 | 7.5 |
| "CONCO Sulfate 912" | 2.5 | 2.5 | 2.5 | 2.5 | 2.5 | 2.5 |
| "CONCO NI-40" | 5.0 | 5.0 | 5.0 | 5.0 | 5.0 | 5.0 |
| hexamethylene glycol | 5.0 | 5.0 | 5.0 | 5.0 | 5.0 | 5.0 |

The quantity made of any formulation depends on the weight of the fabric to be dyed. For light shades about 8–10% of pre-emulsified carrier, based on the weight of the fabric (O.W.F.), is preferable. For medium shades, about 10–15% (O.W.F.) of carrier is preferable. For darker shades, about 15–20% (O.W.F.) of carrier is preferable.

The quantity of dye used depends on the shade. It has been found that the present carrier is effective when the dye concentration is as low as 0.1% (O.W.F.) and as high as 8.0% (O.W.F.). Preferably, however, the dye concentration should be from about 0.5% to about 5.0% (O.W.F.).

Generally, the required concentration of the carrier increases as the dye concentration increases. The carrier should, preferably, be added in pre-emulsified form. Therefore, in compounding the carrier, in such pre-emulsified form, allowance must be made for the water in which it will be emulsified, so the container must be large enough to accomodate about 15–20 times as much liquid as the volume of carrier.

The following example illustrates a typical formulation where 100 pounds of carrier are to be used on 800 pounds of fabric (or 12.5%, O.W.F.).

EXAMPLE 1

In a 400 gallon steam jacketed kettle, place 40 pounds of normal-butyl benzoate and, with constant stirring, add 40 pounds of tertiary butyl phenol. While stirring, heat the mixture to 120°F and add 7.5 pounds of "1-CON-PNP-4" in one-half pound portions over a period of about 5–10 minutes and mix until dissolved then add 2.5 pounds of "CONCO Sulfate 912" in one-half pound portions over a period of about 3–5 minutes and mix until dissolved. Then add 5.0 pounds of "NI-40" in one-half pound portions over a period of about 5 minutes and mix until dissolved, and finally, pour in 5.0 pounds of hexamethylene glycol and stir. The stirring should continue for about an additional hour while the kettle cools to room temperature. The resulting mixture is a dark brown, slightly viscous liquid which constitutes the carrier.

When the carrier is added to the dyebath in preemulsified form, it is emulsified as follows:

EXAMPLE 2

To 100 pounds of carrier in the 400 gallon steam jacketed ketted kettle add 100 pounds of water and maintain agitation of the mixture while heating it to 80°–100°F. Stirring is maintained until a reasonably homogeneous viscous slurry is obtained, at which time water is added in portions until an additional 1000 pounds is added, while maintaining a temperature of 80°–100°F. Stirring is continued until the carrier is dispersed homogeneously.

This is an example of a dispersed or pre-emulsified carrier that is added directly to the dye bath.

Following is a convenient method of testing the properties of the carrier of this invention:

EXAMPLE 3

1. Load 10 grams of Qiana Type 472 Nylon fabric into each of the 12 jars of a "Ahiba Low-Boy Dying Machine". Each jar has a capacity for holding about 20 grams of fabric, and about 500 grams of aqueous solution.
2. Add 40 times the fabric weight of water.
3. Warm to 80°–100°F.
4. Add 90% formic acid drop by drop, until the pH is lowered to about 3.0 ± 0.2 (about 0.2 ml is generally required).
5. Let the machine run for 5 minutes.
6. Add 8%–20% (O.W.F.) of carrier, depending on the quantity of dye to be used, and the depth of shade required.

Since the carrier is added in pre-emulsified form, and since the aqueous emulsion weighs about 12 times as much as the carrier, about 12 times the calculated weight of carrier approximates the weight of the pre-emulsified carrier to be used.

7. Let the machine run for 5 minutes at 80°–100°F.
8. Add the dyestuff.
9. Let the machine run for 5 minutes.
10. Raise the temperature to about 160°F at a rate of about 1° per minute.
11. Let the machine run at about 160°F for about 10 minutes.
12. Raise the temperature to about 180°F at a rate of about 1° per minute.

13. Let the machine run for about 10 minutes.

14. Raise the temperature to about 210°F at a rate of about 1° per minute.

15. Hold the temperature at 210°F, while the machine is running, for about 60 to 120 minutes, depending on the shade desired. Remove the fabric from the jar.

16. View visually for shade. If shade is too light, then replace the fabric in the jar and let the machine run for additional time; or add more dyestuff, replace the fabric in the jar, and let the machine run for additional time. If more dye should be added, let the temperature cool to 180°F before adding the dye, then proceed as above starting with step 14.

16.(a) If the fabric is "on shade", then let the bath cool down to 160°F.

17. When the fabric is on shade, drain the bath after cooling.

18. Recharge the dying machine jars with about 40 times the fabric weight of fresh water.

19. Add about 1% (O.W.F.) of a non-ionic scour, such as "SCOUR CO.", an ethoxylated alcohol made by the Refined Onyx division of the Millmaster Onyx Corporation, Lindhurst, New Jersey.

20. Add about 1% by weight (O.W.F.) of tetrasodium pryophosphate.

21. Heat to 160°F, and scour at 160°F for 30 minutes.

22. Drain the water.

23. Recharge the jar with 40 times the fabric weight of fresh water.

24. Let the machine run for 15 minutes at room temperature.

25. Take the fabric from the jar, and dry it in a conventional manner, such as by using a "tenter frame".

The following representative dyes were tested with the carrier of the present invention.

| Monosulfonated | Manufacturer |
|---|---|
| "Fastusol Turquoise LG" | GAF Corporation, New York, N.Y. |
| Polysulfonated | |
| "Sulpho-Rhodamine B extra" | GAF Corporation, New York, N.Y. |
| "Brilliant Sulpho Flavine FFA" | GAF Corporation, New York, N.Y. |
| Neutral metalized dyes | Sandoz Colors and Chemicals, |
| "Lanasyn Bordeaux GRL" | East Hanover, N.J. |
| Disperse dyes/acid dyes | |
| "Intrasil Red M.G." acid dye alone or mixed with | Cronipton and Knowles, Fairlawn N.J. |
| "Resolin Blue GRL" disperse dye | Verona Dyestuffs, Union, N.J. |
| "Intrasil Red MG" acid dye mixed with | Cronipton and Knowles, Fairlawn N.J. |
| "Resolin Blue GRL" disperse dye and | Verona Dyestuffs, Union, N.J. |
| "Anthraquinone Green GNN"acid dye | Du Pont Chemical Co., Wilmington, Del. |

Each of these dyes was used with each of the six carrier formulations described above. In general, it was found that there was a faster and more complete exhaustion of dye on the Qiana Type 472 Nylon fabric when the proportion of phenol to ester was higher. However, when the proportion of phenol in the carrier was greater than about 50% by weight, emulsification problems arose, and dyeing was often spotted or speckled. But when the proportion of phenol in the carrier was less than about 30% by weight, dye exhaustion from the bath was much slower and poorer than desirable. The preferable range of proportions of phenol to ester is, therefore, between about 1:1 to about 3:7.

It was found that normal-butyl benzoate, when used as the sole swelling agent in the carrier, gave very poor, and very slow dye exhaustion, and resulted in poor shades. On the other hand, when the phenols were used as the sole swelling agent, the polyamide fibers were often degraded, or, because of poor emulsification, the dyeing was often spotted or speckled. It was found that an approximately equal (by weight) mixture of normal-butyl benzoate and a phenol chosen from para-tertiary butyl phenol and para-tertiary amyl phenol provided the most satisfactory results when used as a swelling agent in carriers because it permits ready emulsification in water, does not degrade the polyamide fibers, and permits the rapid and complete exhaustion of many common dyes from the dyebath onto the fabric.

The efficacy of dyeing was determined by matching the depth of shade of the dyed fabrics visually. When the identical dyestuff was used under identical conditions with different carriers, the carrier based on a swelling agent mixture of normal-butyl benzoate and one of the phenols selected from para-tertiary butyl phenol and para-tertiary amyl phenol gave the deepest shades in the least time.

The rate of dye exhaustion was also followed by viewing the residual dyebath solutions in matched cells. The deeper the color of the transmitted light, the more residual dye in the bath and the less the dye exhaustion. The results of these tests indicate that the carriers of the present invention permit the fastest and most complete exhaustion of dyes as compared to carriers of the prior art.

The invention claimed is:

1. A carrier for a dye for polyamide fibers made by the condensation of the monomers 4,4'-diamino-dicyclohexyl methane, or alkylated derivatives thereof, and dodecanoic acid comprising a swelling agent consisting of a mixture of normal-butyl benzoate and an alkyl phenol selected from the group consisting of para-tertiary butyl phenol and para-tertiary amyl phenol, said butyl benzoate and alkyl phenol being present in a ratio to each other of between about 1:2 to about 2:1 by weight.

2. The carrier of claim 1 including a compatible dispersing agent for said swelling agent.

3. The carrier of claim 2 wherein said dispersing agent consists of at least one anionic surfactant, at least one non-ionic surfactant and at least one coupling solvent.

4. The carrier of claim 3 wherein about 10% by weight of the total carrier is anionic surfactant, about 5% by weight of the total carrier is non-ionic surfactant and about 5% by weight of the total carrier is coupling solvent.

5. The carrier of claim 2 wherein said swelling agent comprises about 80% by weight of the carrier and the dispersing agent comprises about 20% by weight of the carrier.

6. A dyeing composition for polyamide fibers made by the condensation of the monomers 4,4′-diamino-dicyclohexyl methane, or alkylated derivatives thereof, and dodecanoic acid a dye, a carrier for said dye and water, said carrier comprising a swelling agent consisting of a mixture of normal-butyl benzoate and an alkyl phenol selected from the group consisting of para-tertiary butyl phenol and para-tertiary amyl phenol, said butyl benzoate and alkyl phenol being present in a ratio to each other of between about 1:2 to about 2:1 by weight.

7. The composition of claim 6 wherein said carrier includes a compatible dispersing agent for said swelling agent.

8. The composition of claim 7 wherein said dispersing agent consists of at least one anionic surfactant, at least one non-ionic surfactant and at least one coupling solvent.

9. The composition of claim 8 wherein about 10% by weight of the total carrier is anionic surfactant, about 5% by weight of the total carrier is non-ionic surfactant and about 5% by weight of the total carrier is coupling solvent.

10. The composition of claim 6 wherein said swelling agent comprises about 80% by weight of the carrier and the dispersing agent comprises about 20% by weight of the carrier.

11. A method of dyeing polyamide fibers made by the condensation of the monomers 4,4′-diamino-dicyclohexyl methane, or alkylated derivatives thereof, and dodecanoic acid which comprises applying to said fibers a dyeing composition comprising a dye, a carrier for said dye and water, said carrier comprising a swelling agent consisting of a mixture of normal-butyl benzoate and an alkyl phenol selected from the group consisting of para-tertiary butyl phenol and para-tertiary amyl phenol, said butyl benzoate and alkyl phenol being present in a ratio to each other of between about 1:2 to about 2:1 by weight.

12. The method of claim 11 wherein said carrier is incorporated in an aqueous emulsion prior to admixture with said dye.

13. The method of claim 12 wherein the aqueous emulsion of said carrier includes water and a dispersing agent that is compatible with said swelling agent.

14. The method of claim 13 wherein said dispersing agent consists of at least one anionic surfactant, at least one non-ionic surfactant and at least one coupling solvent.

15. The method of claim 14 wherein about 10% by weight of the total carrier is anionic surfactant, about 5% by weight of the total carrier is non-ionic surfactant and about 5% by weight of the total carrier is coupling solvent.

16. The method of claim 11 wherein said swelling agent comprises about 80% by weight of the carrier and the dispersing agent comprises about 20% by weight of the carrier.

* * * * *